US006972654B1

(12) United States Patent
Brock

(10) Patent No.: US 6,972,654 B1
(45) Date of Patent: Dec. 6, 2005

(54) ARMORED MAGNETIC BASE

(75) Inventor: Robert William Brock, Beaverton, OR (US)

(73) Assignee: Mr. Magnet, Inc., Beaverton, OR (US)

( * ) Notice: Subject to any disclaimer, the term of this patent is extended or adjusted under 35 U.S.C. 154(b) by 0 days.

(21) Appl. No.: 10/306,977

(22) Filed: Nov. 27, 2002

(51) Int. Cl.[7] ..... H01F 7/20
(52) U.S. Cl. ..... 335/285; 335/301; 335/303
(58) Field of Search ..... 335/285–288, 335/295, 301–306

(56) References Cited

U.S. PATENT DOCUMENTS

| | | | | |
|---|---|---|---|---|
| 2,152,897 | A | 4/1939 | Madore | |
| 2,176,052 | A | 10/1939 | Beyer | |
| 3,755,857 | A | 9/1973 | Simoneaux | |
| 4,325,504 | A | 4/1982 | Amani | |
| 5,196,818 | A | 3/1993 | Anderson | |
| 5,333,767 | A | 8/1994 | Anderson | |
| 6,568,805 | B1 * | 5/2003 | Dietz | 351/112 |
| 6,677,845 | B1 * | 1/2004 | Fader et al. | 335/285 |
| 2003/0230606 | A1 | 12/2003 | Devinie | |
| 2004/0069916 | A1 | 4/2004 | Cohen | |
| 2004/0173484 | A1 | 9/2004 | Bates et al. | |

OTHER PUBLICATIONS

Super Wrist Magnet EZ Red Co. EZWM396, Amazon.com web page, at least as early as Jan. 2005, 3 pages.
Silver Back Magnetic Powered Gloves, www.silverback-gloves.com web page, at least as early as Jan. 2005, 1 page.
Silver Back web page from web. archive.org, Aug. 23, 2003, 1 page.

* cited by examiner

*Primary Examiner*—Ramon M. Barrera
(74) *Attorney, Agent, or Firm*—Karen Dana Oster

(57) ABSTRACT

An armored magnetic base of the present invention includes a magnet enclosed within a protective sleeve. The magnet may have an optional shielding casing substantially covering one face of the magnet. The protective sleeve may be a tube made of rubber, plastic, or shrink-wrap material or other expandable and/or contractible material. In one preferred embodiment, a mounting apparatus is interconnectable with the magnet. The mounting apparatus may be used for mounting the armored magnetic base to a convenient location such as a user's person, a tool, a flat surface, or a pole. The present invention also includes a method for making an armored magnetic base including the steps of inserting the magnet into a tubular protective sleeve and contracting the tubular protective sleeve to secure the magnet therein.

13 Claims, 6 Drawing Sheets

ARMORED MAGNETIC BASE

BACKGROUND OF INVENTION

The present invention is directed to an armored magnetic base, and more specifically to a magnet enclosed in a protective sleeve that may be mounted to a user's person, a tool, or any convenient place.

How often have you been working on a project and dropped a small, but crucial item? It may have been a pin, a paperclip, a nail, a small tool, or a pencil. You would have to stop what you were doing, climb down from the ladder (if you were on a ladder), and search for the offending item.

Inventors have realized the power of magnets for holding small metal items for decades. U.S. Pat. No. 2,152,897 to Madore is directed to a magnet clip to hold hairpins. In one embodiment, the magnet clip could be attached to a towel or apron that could be placed over the shoulders of a person having his hair done. In an alternative embodiment, the Madore magnet clip would be attached to a handle. In one embodiment, the Madore magnet clip could be attached to a user's wrist using a wristband. U.S. Pat. No. 2,176,052 to Beyer is directed to a wrist carried implement holder. Modern inventors continued to develop the idea of using magnets to hold small items. For example, U.S. Pat. No. 3,755,867 to Simoneaux is directed to a magnetic hair clip holder that includes a bracelet with a magnet mounted to the side.

Most of the devices would allow the items to touch the bare magnet. Pins and hairclips are not particularly dirty. They are also not particularly damaging to the surface of a magnet. Nails, screws, blades, and other items used by handymen and construction workers U.S. Pat. No. 4,325,504 to Amani is directed to a contractible bracelet (such as elastic) that is adapted to accommodate a magnet. The Amani device includes a "keeper" that is a flat, circular plate or disc approximately the diameter of the magnet, made of some magnetizable metal such as iron. The keeper is placed across the poles of the magnet whenever the device is out of use for extended periods.

U.S. Pat. No. 5,196,818 and U.S. Pat. No. 5,333,767, both to Anderson (the "Anderson references") are directed to a wrist mounted magnetic holder for small articles such as screws, nails, bolts, drill bits and the like having a non-ferrous material housing with a ceramic magnet polarized into two distinct regions and a flux concentrator for increasing the magnetic flux density at the holding surface. A non-magnetic cover plate is used to secure the magnet and the concentrator plate within the cavity of the non-ferrous material housing. Securing the cover plate requires the use of adhesive. This non-magnetic cover plate has at least some thickness that separates the small articles from the magnet. This distance weakens the attraction of the magnet to the small articles. The entire device is secured to the wrist with a strap that is connected to wing-shaped extensions on either side of the cavity. The non-ferrous material housing must be specially manufactured, an expensive process. Further, the shown configuration would be complicated to manufacture and uncomfortable to wear.

BRIEF SUMMARY OF THE INVENTION

The present invention is directed to an armored magnetic base including a magnet enclosed within a protective sleeve. The magnet may have an optional shielding casing substantially covering one face of the magnet. The protective sleeve may be a tube made of rubber, plastic, or shrink-wrap material or other expandable and/or contractible material. In one preferred embodiment, a mounting apparatus is interconnectable with the magnet. The mounting apparatus may be used for mounting the armored magnetic base to a convenient location such as a user's person, a tool, a flat surface, or a pole.

The present invention also includes a method for making an armored magnetic base including the steps of inserting a magnet into a tubular protective sleeve and contracting the tubular protective sleeve to secure the magnet within the tubular protective shrink-wrap sleeve. An additional step of inserting a tool into the tubular protective sleeve may be added to the method. The tubular protective sleeve may be contracted by heating.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
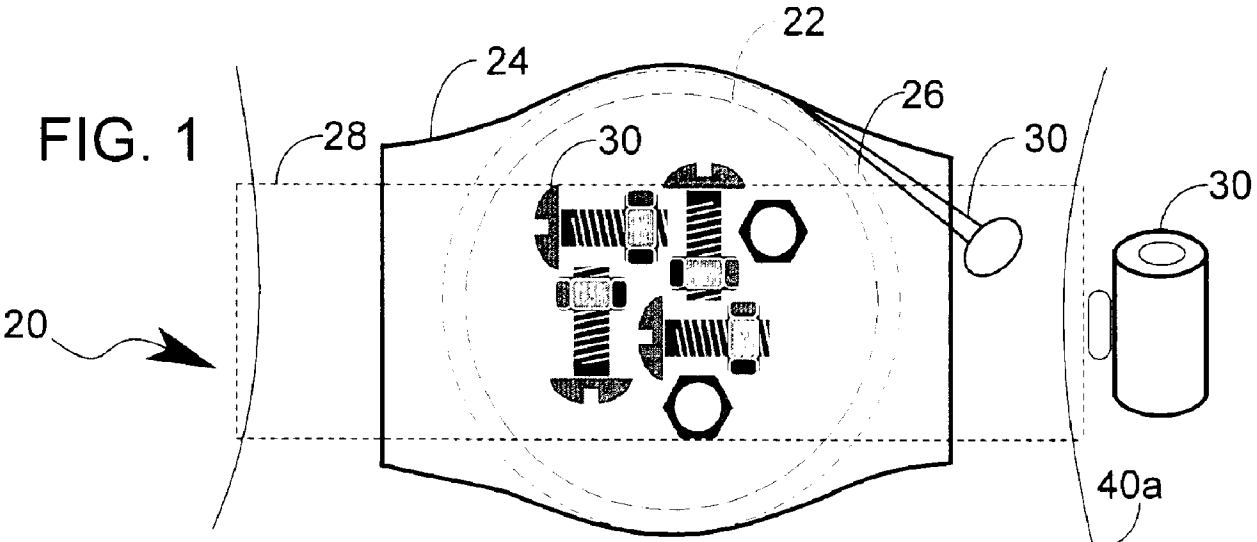
FIG. 1 is a top plan view of an armored magnetic base of the present invention that includes a magnet enclosed in a protective sleeve attached to a user's wrist using a flexible connection member mounting apparatus.

As shown in FIGS. 1–4, the present invention is directed to an armored magnetic base 20 that includes a magnet 22 enclosed in a protective sleeve 24. In one alternative preferred embodiment, a shielding casing 26 substantially covers one face of the magnet 22. In an alternative preferred embodiment, a mounting apparatus 28 (including 28*a*, 28*b*, 28*c*, 28*d*) is included that is interconnectable with the magnet 22. The magnet 22 may be to attract articles 30 such as nuts, bolts, nails, bits, sockets, screws, and other metallic items. The protective sleeve 24 protects the magnet 22 from dirt and oil common on articles 30 used in construction. The protective sleeve 24 also protects the magnet 22 from nicks, scratches, and cuts caused by sharp articles 30. Although the protective sleeve 24 protects the magnet 22, because it is relatively thin and flexible, it allows the articles 30 to come in very close proximity to the magnet 22 and thus creates only minimal interference with the magnetic pull. In some embodiments, the protective sleeve 24 may even be used as the mounting apparatus 28. The resulting armored magnetic base 20 may be positioned in convenient locations so that the user is able to store, remove, and replace articles 30 on the armored magnetic base 20, as they are needed.

In one preferred embodiment, the magnet 22 has a top magnet face 32 and a bottom magnet face 34. The top magnet face 32 is an attracting face that is suitable to attract metallic articles 30. The magnet 22 may optionally have a hole defined therein. If the magnet 22 has a hole therein, an additional magnet 36 (FIG. 4) may be inserted into the hole to make a cumulatively more powerful magnet. In one preferred embodiment, an optional shielding casing 26 substantially covers the bottom magnet face 34. The shielding casing 26 has the substantial effect of directing the magnetic force towards the top magnet face 32. The shielding casing 26 may also have a hole defined therein. If the shielding casing 26 has a hole therein, a securing apparatus 38 (FIG. 2) may be inserted therethrough to further secure the magnet 22 within the protective sleeve 24 and to either a connection member or flat surface. A magnet 22 with a hole having a shielding casing 26 may be, for example, a RB-50 or RB-70 (Pot Magnet) or a magnet that is a standard, "off-the-shelf" round base magnet. Exemplary RB-50 or RB-70 magnets are produced by Ningbo Lihe Permanent Magnetic Materials Manufacturer, NO. 10 Lane 172 XingNing Road 315040 Ningbo China and may be purchased at http://www.allmagnetics.com. Because of their low cost, high holding power, and compact design, these magnetic bases are very versatile. They are constructed of powerful ceramic ring magnets encased in plated steel cups (shielding casing), with an attachment hole in the center. It should be noted, however, that other size, shapes, magnetic powers, and variations on the magnet 22 and/or shielding casing 26 might be used in place of those shown. The holes in the magnet 22 and shielding casing 26 are also optional. Further, it should be noted that the shielding casing 26 is an optional feature of the present invention.

As set forth above, the protective sleeve 24 may protect the magnet 22 from general wear including dirt, oil, nicks, scratches, and cuts. The protective sleeve 24 may also help insulate the magnet 22 from impacts. Further, the protective sleeve 24 may help prevent clean surfaces from being marred. The protective sleeve 24 is preferably washable and most types of dirt and oil can be brushed off or wiped off. Depending on the material from which the protective sleeve 24 is made, notes may be taken on the protective sleeve 24 and either erased, rubbed off, or washed clean. The sleeve 24 may also be imprinted with a logo. As will be discussed, in some embodiments the protective sleeve 24 may even be used as the mounting apparatus 28.

The protective sleeve 24 of the present invention, in one preferred embodiment is a plastic shrink-wrap or contractible tube. As shown in FIG. 1, in one preferred embodiment of the tube protective sleeve 22, when shrunk or contracted around the magnet 22, fits snugly around the magnet 22, but has two opposite open ends. The mounting apparatus 28 may be inserted through the opposite open ends of the protective sleeve 24. Additional articles 30, including articles that are not attracted to a magnet (e.g. articles made of wood, plastic, stainless steel), may be inserted (as shown in FIG. 1) into one or both of the opposite open ends of the protective sleeve 24.

Figure 2:
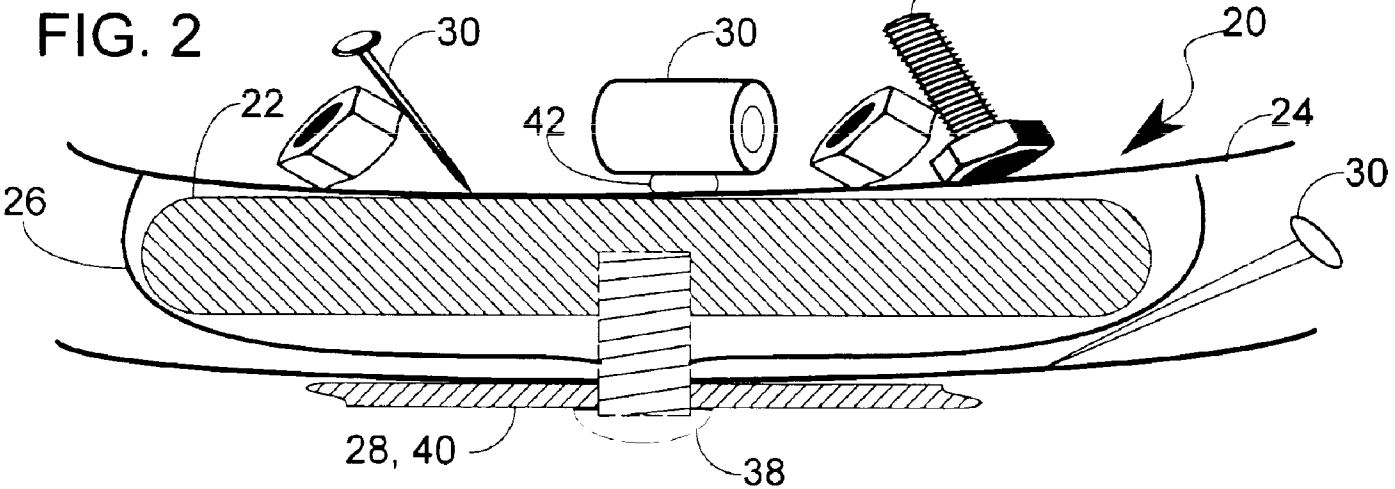
FIG. 2 is a cross-sectional side view of an armored magnetic base of the present invention that includes a magnet enclosed in a protective sleeve attached to a connection member or a flat surface.
Figure 3:
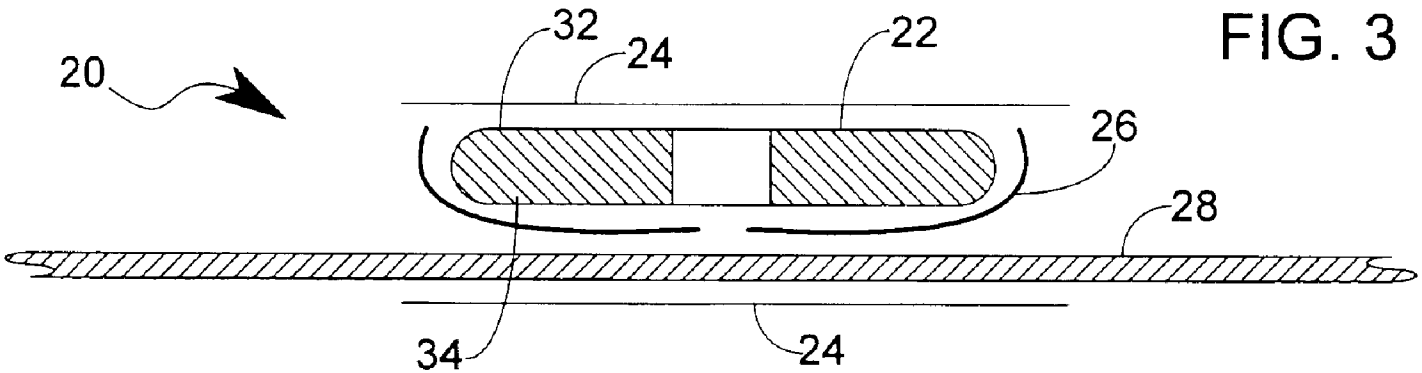
FIG. 3 is a cross-sectional side view of an armored magnetic base of the present invention that includes a magnet enclosed in a protective sleeve, a flexible connection member mounting apparatus inserted through the protective sleeve.
Figure 4:
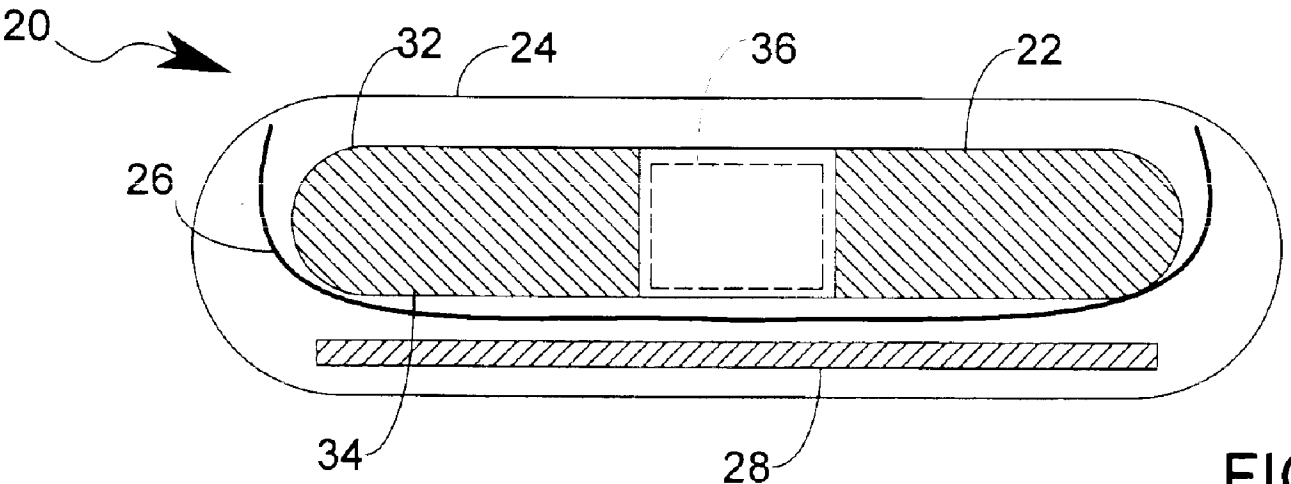
FIG. 4 is a cross-sectional end view of an armored magnetic base of the present invention that includes a magnet enclosed in a protective sleeve a flexible connection member mounting apparatus inserted through the protective sleeve.

Initially the protective sleeve 24 may be taut or stretched tight over the edges of the shielding casing 26 so that the protective sleeve 24 is in a spaced relationship with the top magnet face 22 of the magnet 22. Because the protective sleeve 24 is relatively thin and flexible, it allows the articles 30 to come in very close proximity to the magnet 22 and thus creates only minimal interference with the magnetic pull. The close proximity relationship is shown in FIG. 2 with the top surface of the protective sleeve 24 flexing downward toward the magnet 22 as the articles 30 are drawn to the magnet 22. It should be noted after time, the tautness may not return. It should also be noted that in alternative embodiments the edges of the shielding casing 26 may be lower than the top magnet face 22 such that no flexing is necessary.

One protective sleeve 24 that may be use is a tubular protective shrink-wrap sleeve 24 such as INSUL-GRIP, HS-Polyolefin: INSULTAB, Inc., 50 Everberg Road, Woburn, Mass. 01801. The protective sleeve 24 may also be made from alternative materials such as rubber, PVC, Polyolefin, Acrylated Polyolefin, elastic, and other materials that can expand or contract on their own or through the use of specific methods.

This product may be constructed by inserting the magnet 22 into the tubular protective shrink-wrap sleeve 24 and then contracting or shrinking the tubular protective shrink-wrap sleeve 24 to secure the magnet 22 within the tubular protective shrink-wrap sleeve 24. To shrink the tubular protective shrink-wrap sleeve 24, heat may be applied to the shrink-wrap material. In one exemplary embodiment, to tubular protective shrink-wrap sleeve 24, heat in the form of a heat gun or a propane touch to an approximate temperature of 90° C. (194° F.). It should be noted that different types of shrink-wrap material might be shrunk using different methods, different types of heat, and/or different temperatures. In one exemplary embodiment, the shrink-wrap material is heated only from one face (e.g. bottom magnet face 34). By shrinking the shrink-wrap material on only one face, the flexibility of the material and the optional printed logo proportions on the front are preserved.

In an alternative embodiment, the product may be constructed by inserting the magnet 22 into a contractible tubular protective sleeve 24. In this embodiment, the contractible tubular protective sleeve 24 has a minimum diameter when the tube is not being stretched and a maximum diameter slightly larger than the diameter of the magnet 22. In this embodiment, the contractible tubular protective sleeve 24 stretches as the magnet 22 is inserted therein. The magnet 22 is held within the contractible tubular protective sleeve 24 as the protective sleeve 24 contracts to trap the magnet 22.

Although this invention is generally described as using a tube, it is possible to implement this invention using an envelope, a pouch, or other shapes into which the magnet may be inserted.

Figure 6:
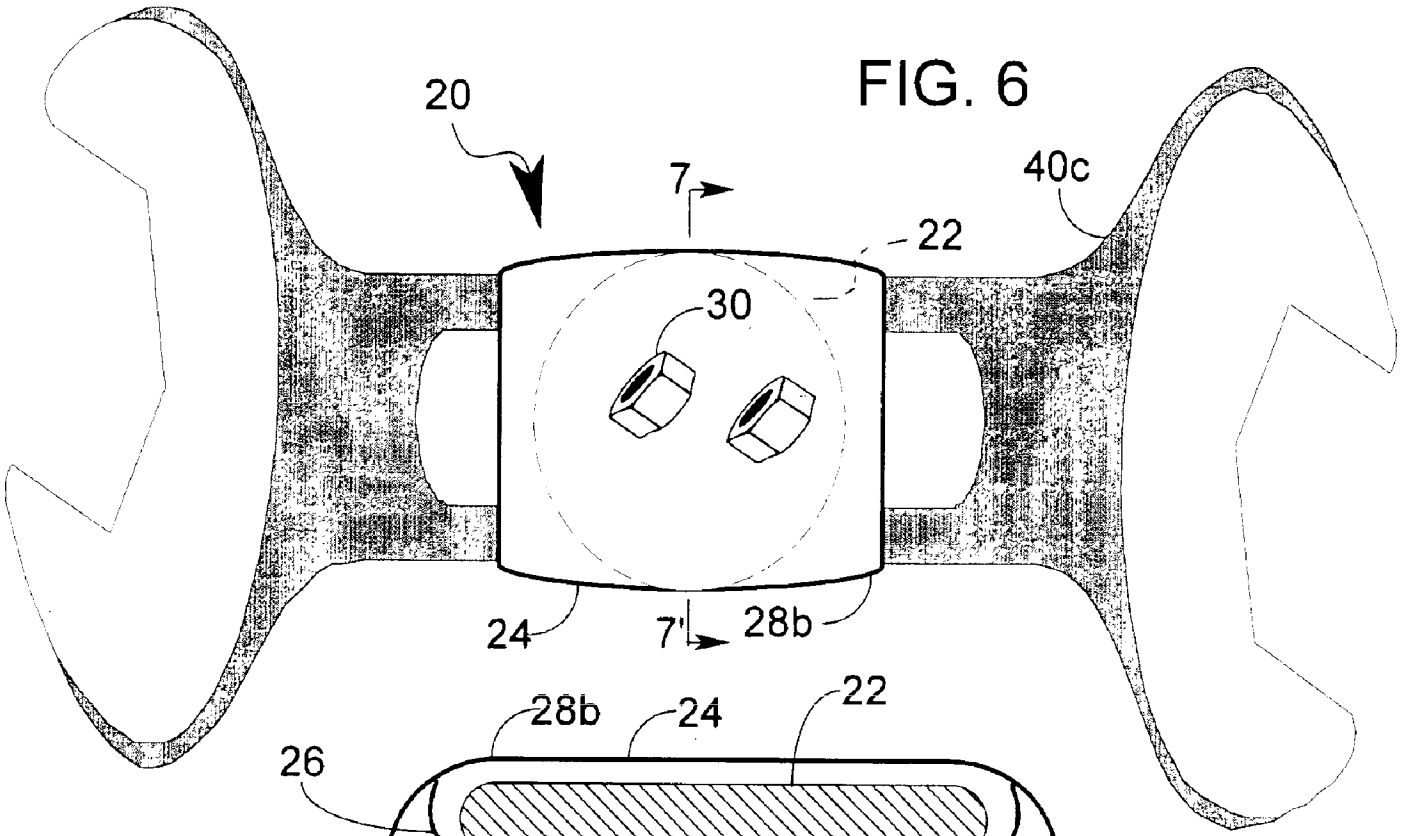
FIG. 6 is a top plan view of an armored magnetic base of the present invention attached to a tool using a tubular protective shrink-wrap sleeve as a connection member.
Figure 7:
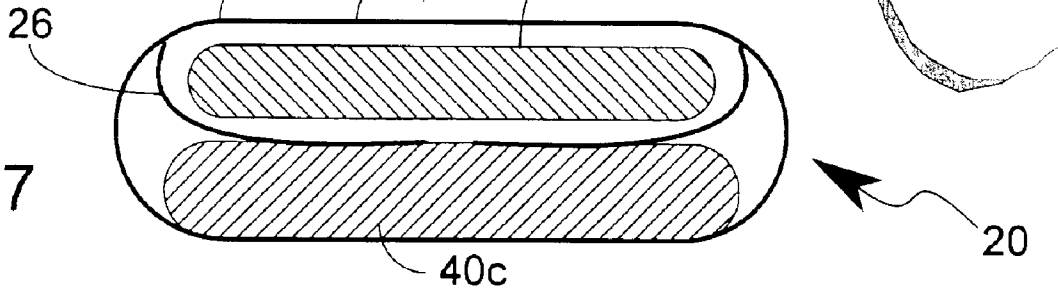
FIG. 7 is a cross-sectional end view taken along line 7—7' of FIG. 6 of an armored magnetic base of the present invention attached to a tool using a tubular protective shrink-wrap sleeve as a connection member.

The mounting apparatus 28 may be, for example, a flexible connection member 28*a* (FIGS. 1–5), the protective sleeve 28*b* (FIGS. 6–8), a mechanical connector 28*c* (FIG. 10), adhesive 28*d* (FIG. 11), and other mounting apparatus. The mounting apparatus 28 may connect directly or indirectly to the magnet 22. For example, the mechanical connector 28*c* and the adhesive 28*d* do not connect directly to the magnet, but do functionally connect to the magnet through the protective sleeve 28.

Figure 5:
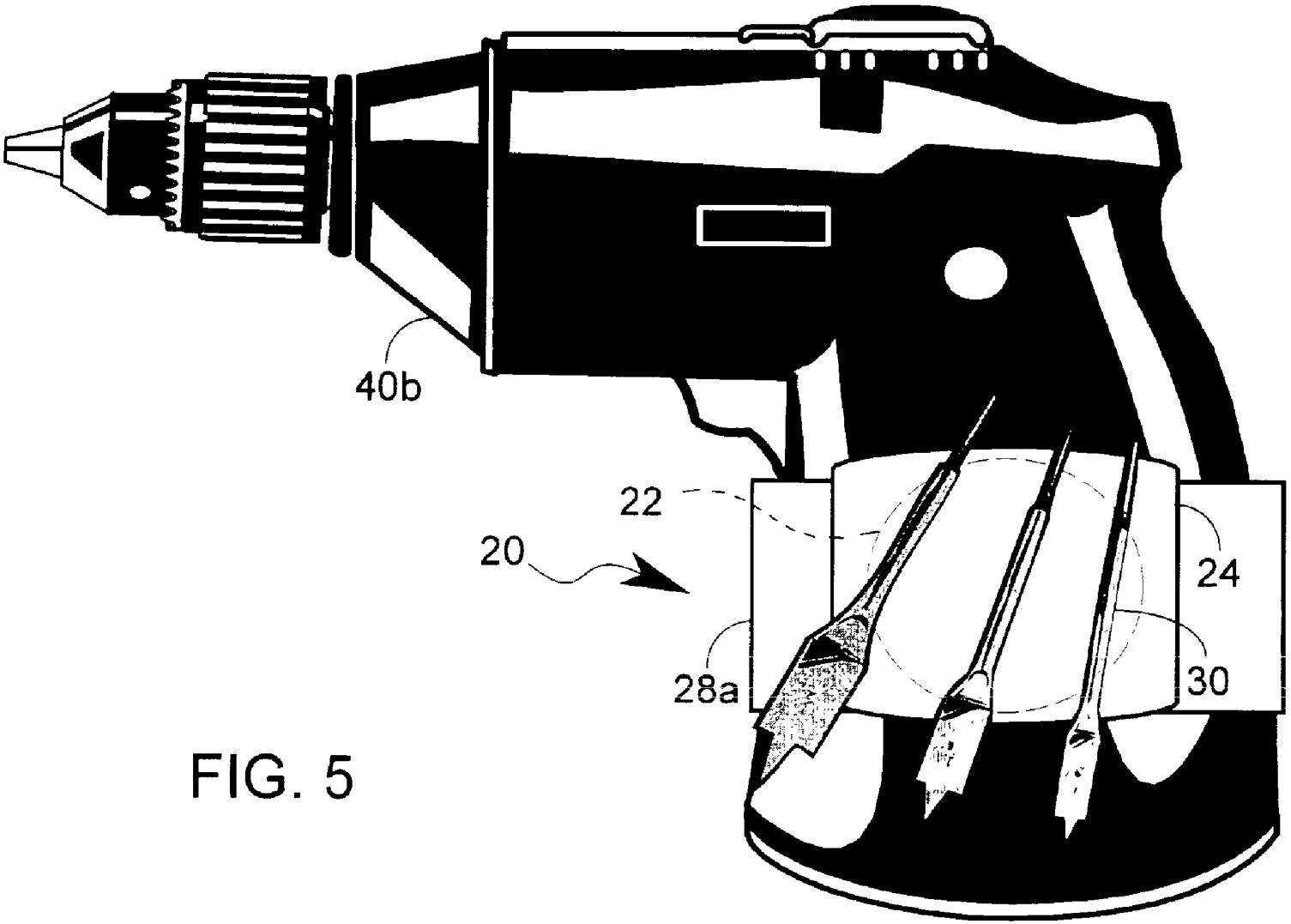
FIG. 5 is a top plan view of an armored magnetic base of the present invention attached to a tool using a flexible connection member mounting apparatus.

FIGS. 1–5 show a flexible connection member 28*a* that may be a piece of hook and loop fabric (e.g. ONE-WRAP, Velcro USA Inc., 406 Brown Avenue, Manchester, N.H. 03103) that may be attached, for example, to the user's person (e.g. wrist, neck, waste) 40*a* (shown as a wrist in FIG. 1) or the base of a tool 40*b* (FIG. 5). If the flexible connection member 28*a* is connected to the magnet 22 by threading the flexible connection member 28*a* through the protective sleeve 24, then the flexible connection member 28*a* can be easily removed and replaced if it is dirty, frayed, or if an alternative connection member 28 is desired. One advantage of using the hook and loop fabric is that the loop side can be positioned towards the user's wrist for comfort. By attaching portions of the loop fabric to small articles, additional articles 30 may be attached to the hook side of the hook and loop fabric strip. Other flexible connection member may include, for example, fabric (e.g. elastic, lycra, nylon flat webbing), cording (e.g. string, wire, nylon, hemp, cotton), leather strap or belt, or wire. The flexible connection member 28*a* may be a strip having two ends that are secured using traditional securing means (e.g. a buckle, a latch, adhesive, and hook & loop material). The flexible connection member 28*a* also may be a bracelet-like device similar to a watchband or a sweatband.

Figure 9:
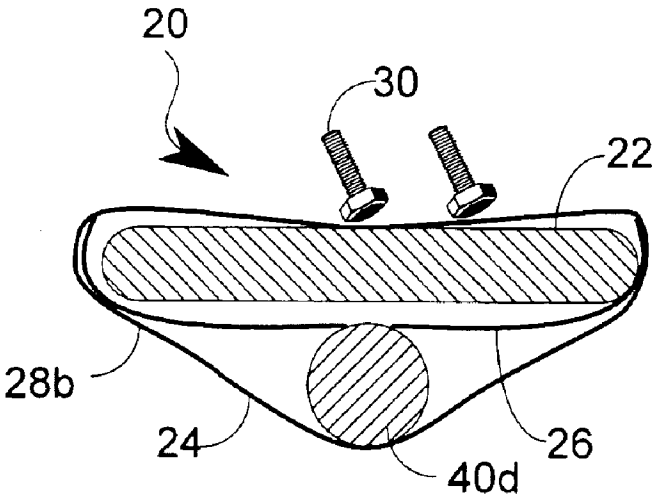
FIG. 9 is a cross-sectional end view taken along line 9—9' of FIG. 8 of an armored magnetic base of the present invention attached to a tool using a tubular protective shrink-wrap sleeve as a connection member.
Figure 8:
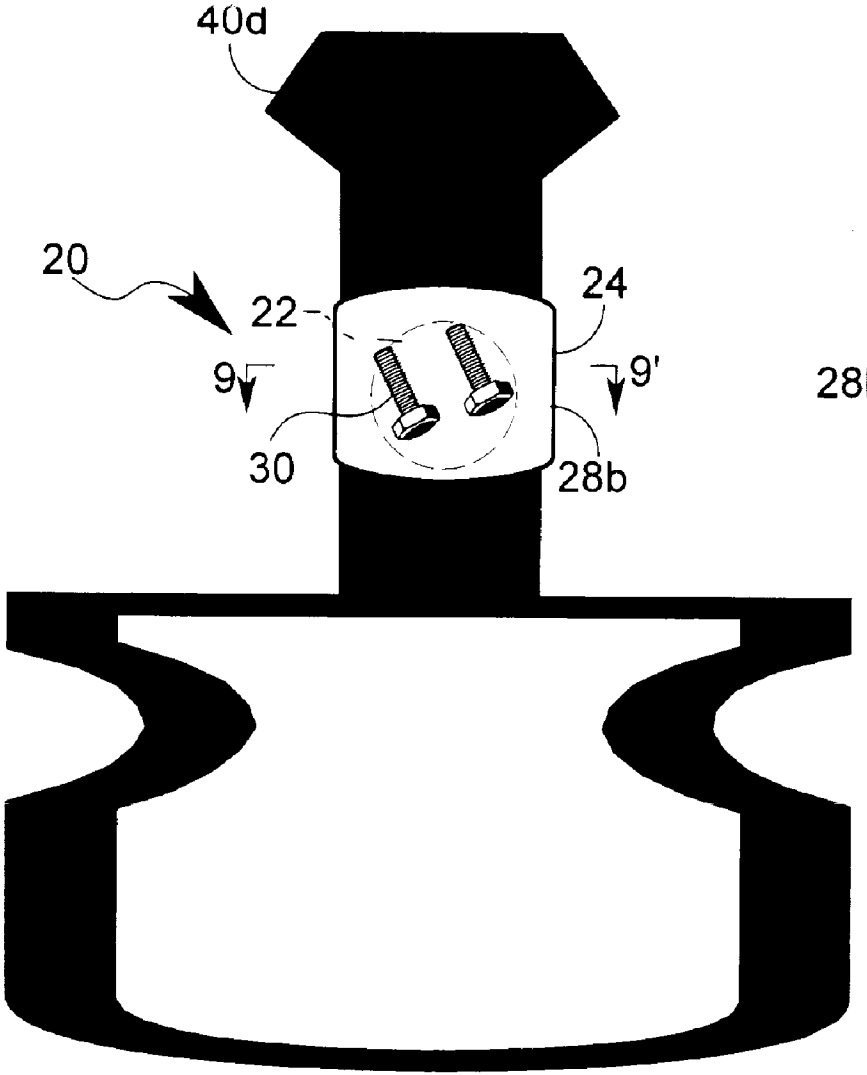
FIG. 8 is a top plan view of an armored magnetic base of the present invention attached to a tool using a tubular protective shrink-wrap sleeve as a connection member.

The protective sleeve 24 may also function as a connection member 28*b* (FIGS. 6–9). In this embodiment, the user may attach the armored magnetic base 20 to a favorite tool 40*c* (FIGS. 5–7), 40*d* (FIGS. 8–9). To make an apparatus using the protective sleeve 24 that functions as a connection member 28*b*, after the magnet 22 is inserted into the tubular protective sleeve 24 the tool 40*c*, 40*d* is inserted into the tubular protective sleeve 24. Then, the tubular protective sleeve 24 is shrunk or contracted to secure the magnet 22 within the tubular protective sleeve 24. It should be noted that the user might be provided with a kit and instructions so he could attach his own tool to the armored magnetic base 20. Alternatively, a manufacturer could make a line of tools each having a pre-attached armored magnetic base 20.

Figures 10, 11:
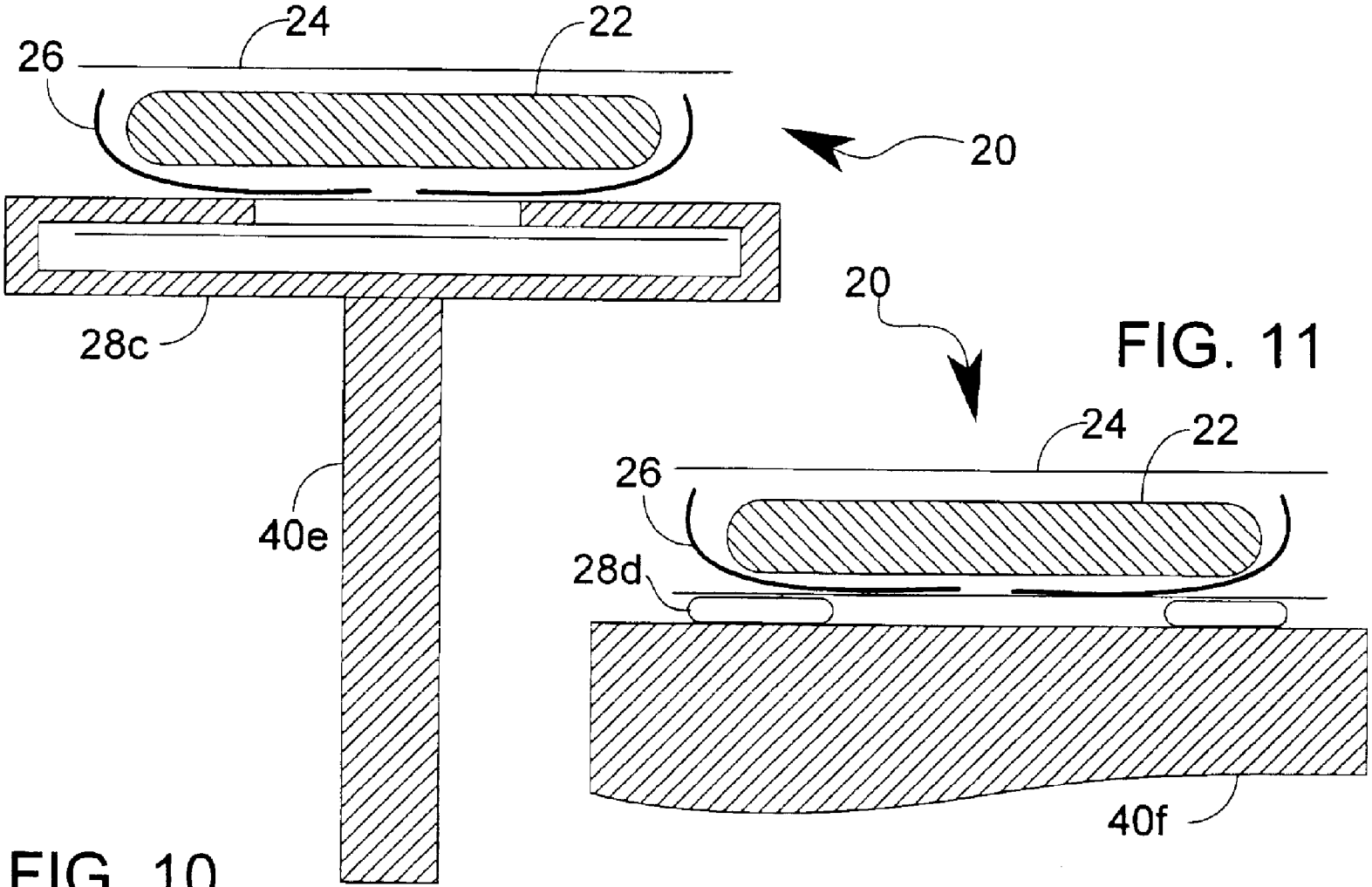
FIG. 10 is a cross-sectional side view of an armored magnetic base of the present invention attached to a pole using a mechanical connector as a connection member.
FIG. 11 is a cross-sectional side view of an armored magnetic base of the present invention attached to a flat surface using adhesive as a connection member.

FIG. 10 shows a mechanical connector 28*c* (FIG. 10) being used as a mounting apparatus 28. This mechanical connector 28*c* is meant to be exemplary and other mechanical connectors 28*c* such as a metal or plastic clamp, hook, clip, latch, or other fastening apparatus may be used. These mechanical connectors 28*c* may be used to attach the armored magnetic base 20 to convenient locations 40*a*–40*f* such as those described below.

FIG. 11 shows adhesive 28*d* (FIG. 11) being used as a mounting apparatus 28. The adhesive 28*d* may be, for example, glue, epoxy, sticky tape, hook & loop fabric. The adhesive 28*d* may be permanent or temporary.

The armored magnetic base 20 may be positioned in any convenient location. For example, FIG. 1 shows the armored magnetic base 20 attached to a user's person 40*a*, FIGS. 5–9 show the armored magnetic base 20 attached to a tool 40*b*, 40*c*, 40*d*, FIG. 10 shows the armored magnetic base 20 attached to a pole 40*e* (so that it may be used to attract items that are dropped into tight spaces), and FIG. 11 shows the armored magnetic base 20 attached to a flat surface 40*f* (such as on a wall, under a desk, under a shelf, or under the hood of a car). Other convenient locations may include a user's belt, around the user's neck, or on a ladder.

It should be noted that articles 30 that are not magnetic might be made magnetic by attaching a piece of metal 42 or other material that will be attracted to the magnet 22.

Terms such as top, bottom, front, back, left side, and right side, are relative and are used for the purpose of description, not to limit the scope of the invention. Further, the figure show exemplary embodiments and are not meant to be limiting in terms of size, shape, and proportions.

The terms and expressions that have been employed in the foregoing specification are used as terms of description and not of limitation, and are not intended to exclude equivalents of the features shown and described or portions of them. The scope of the invention is defined and limited only by the claims that follow.

What is claimed is:

1. An armored magnetic base, comprising:

(a) a magnet having a top magnet face and a bottom magnet face, said top magnet face being an attracting face;

(b) a shielding casing, said shielding casing substantially covering said bottom magnet face;

(c) a protective sleeve enclosing said magnet and said shielding casing; and (d) said protective sleeve being made from a material selected from the group consisting of:

(i) rubber;

(ii) PVC;

(iii) Polyolefin;

(iv) Acrylated Polyolefin;

(v) elastic;

(vi) lycra; and (vii) shrink-wrap material.

2. The armored magnetic base of claim 1, said protective sleeve being a tube.

3. The armored magnetic base of claim 1, further comprising a mounting apparatus interconnectable with said magnet.

4. The armored magnetic base of claim 3, said mounting apparatus being selected from the group consisting of:

(a) (withdrawn) said protective sleeve;

(b) (withdrawn) a flexible connection member;

(c) (withdrawn) adhesive; and (d) a mechanical connector.

5. The armored magnetic base of claim 3, said mounting apparatus for mounting said magnet enclosed in said sleeve to a convenient location selected from the group consisting of:

(a) (withdrawn) a user's person;

(b) a tool;

(c) (withdrawn) a flat surface; and (d) (withdrawn) a pole.

6. An armored magnetic base, comprising:

(a) a magnet having a top magnet face and a bottom magnet face, said top magnet face being an attracting face;

(b) a contractible tubular protective sleeve, said magnet enclosed within said contractible tubular protective sleeve; and (c) a shielding casing, said shielding casing substantially covering said bottom magnet face, said contractible tubular protective sleeve enclosing said magnet and said shielding casing;

(d) wherein said contractible tubular protective sleeve is contracted to secure said magnet within said contractible tubular protective sleeve.

7. The armored magnetic base of claim 6, said contractible tubular protective sleeve being made from a material selected from the group consisting of:

(a) (withdrawn) rubber;

(b) (withdrawn) PVC;

(c) (withdrawn) Polyolefin;

(d) (withdrawn) Acrylated Polyolefin;

(e) (withdrawn) elastic;

(f) (withdrawn) lycra; and (g) shrink-wrap material.

8. The armored magnetic base of claim 6, further comprising a mounting apparatus interconnectable with said magnet.

9. The armored magnetic base of claim 8, said mounting apparatus being selected from the group consisting of:

(a) (withdrawn) said protective sleeve;

(b) (withdrawn) a flexible connection member;

(c) (withdrawn) adhesive; and (d) a mechanical connector.

10. The armored magnetic base of claim 8, said mounting apparatus for mounting said magnet enclosed in said sleeve to a convenient location selected from the group consisting of:

(a) (withdrawn) a user's person;

(b) a tool;

(c) (withdrawn) a flat surface; and (d) (withdrawn) a pole.

11. A method for making an armored magnetic base, said method comprising the steps of:

(a) providing a magnet having a top magnet face and a bottom magnet face, said top magnet face being an attracting face;

(b) inserting said magnet into a contractible tubular protective sleeve;

(c) contracting said contractible tubular protective sleeve to secure said magnet within said contractible tubular protective sleeve; and (d) inserting a tool into said contractible tubular protective sleeve prior to said step of contracting said contractible tubular protective sleeve to secure said magnet and said tool within said contractible tubular protective sleeve.

12. The method of claim 11 wherein said step of contracting said contractible tubular protective sleeve further comprises the step of heating said contractible tubular protective sleeve to shrink said contractible tubular protective sleeve.

13. The method of claim 11 further comprising the step of attaching a mounting apparatus interconnectable with said magnet.

* * * * *